US012454840B2

(12) United States Patent
Ferrini

(10) Patent No.: US 12,454,840 B2
(45) Date of Patent: Oct. 28, 2025

(54) POOL STAIRCASE WITH ENCLOSED FILTERING COMPONENTS

(71) Applicant: 9257-4607 QUÉBEC INC., Laval (CA)

(72) Inventor: Fabrice Ferrini, Blainville (CA)

(73) Assignee: 9257-4607 QUÉBEC INC., Laval (CA)

( * ) Notice: Subject to any disclaimer, the term of this patent is extended or adjusted under 35 U.S.C. 154(b) by 199 days.

(21) Appl. No.: 18/375,268

(22) Filed: Sep. 29, 2023

(65) Prior Publication Data

US 2025/0109603 A1 Apr. 3, 2025

(51) Int. Cl.
*E04H 4/14* (2006.01)
*E04H 4/12* (2006.01)

(52) U.S. Cl.
CPC ..... *E04H 4/144* (2013.01); *E04H 4/1209* (2013.01)

(58) Field of Classification Search
CPC ..... A47K 17/02; A47K 3/12–127; A47K 3/281–282; A61G 7/1005; A61H 33/6005; E04H 4/0031–0043; E04H 4/0075–0093; E04H 4/1209; E04H 4/1245–1254; E04H 4/14; E04H 4/144
See application file for complete search history.

(56) References Cited

U.S. PATENT DOCUMENTS 3,744,198 A * 7/1973 Boassy ..... E04H 4/144 52/184
4,527,297 A * 7/1985 Pettit ..... E04H 4/1209 182/86
4,599,835 A * 7/1986 Rinke ..... E04H 4/144 D25/2
4,801,378 A * 1/1989 Desjoyaux ..... E04H 4/148 210/167.2
5,056,167 A 10/1991 Cholley
5,333,322 A * 8/1994 Weir ..... E04H 4/14 4/578.1
5,644,873 A * 7/1997 Bourgault ..... E06C 1/26 52/182
5,715,907 A * 2/1998 Andret ..... E04H 4/144 182/115
5,916,098 A * 6/1999 Crelin ..... E04H 4/144 52/190
7,036,951 B2 5/2006 St-Hilaire
9,388,594 B2 * 7/2016 Erlich ..... E04H 4/1263
2006/0236447 A1 * 10/2006 St-Hilaire ..... E04H 4/144 4/506

(Continued)

FOREIGN PATENT DOCUMENTS

WO 2022220786 A1 10/2022

*Primary Examiner* — David P Angwin
*Assistant Examiner* — Nicholas A Ros
(74) *Attorney, Agent, or Firm* — Benoit&Cote Inc.; Charles-Andre Caron

(57) ABSTRACT

A staircase for a swimming pool, the staircase being distinct and separate from the swimming pool and removably installable therein. The staircase comprises steps and risers defining a hidden space behind it. Inlets and/or outlets of a filtering system are mounted to the risers of the staircase, with the tube connecting the riser-mounted inlets and outlets extending in the hidden space defined by the staircase. The staircase and connecting components of the filtering system hidden in the staircase are easily removable from the swimming pool during the weather season.

15 Claims, 11 Drawing Sheets

(56) References Cited

U.S. PATENT DOCUMENTS

| | | | | |
|---|---|---|---|---|
| 2008/0120928 | A1* | 5/2008 | St-Pierre | E04F 11/022 4/496 |
| 2014/0150358 | A1 | 6/2014 | St-Pierre | |
| 2020/0263715 | A1* | 8/2020 | Nelson | F16B 37/042 |
| 2021/0121023 | A1* | 4/2021 | Valdez | A47B 96/022 |

* cited by examiner

POOL STAIRCASE WITH ENCLOSED FILTERING COMPONENTS

BACKGROUND

(a) Field

The subject matter disclosed generally relates to swimming pools. More particularly, the subject matter disclosed relates to swimming pools and water-filtering components.

(b) Related Prior Art

Swimming pools require water filtering systems to keep the water safe for swimming. In nowadays designs of swimming pools, the components of the filtering system are typically located outside the swimming pool, with tubes extending between the wall of the swimming pool and the filtering components. As the swimming season ends, for the winter, in Canada and other locations where the water freezes during winter, people are required to prepare the swimming pool for the winter, including removing the immersed step or ladder used to exit the swimming pool, and to place filtering system in proper condition for the winter season. The last step involves disconnecting tubes, disconnecting the filtering pump, and prepare components remaining connected to the swimming pool for the winter season. Accordingly, some components can be stored in a safe location protected from the winter weather, like a shed, while other must remain outside with potential premature wear resulting thereof. For example, U.S. Pat. No. 5,644,873A teaches stairs not mechanically fastened to the pool.

Such process requires knowledge of the different winter preparation steps involves in the preparation of each of the individual components of the filtering system, as time to perform them. Furthermore, having components of the filtering system remaining outside during the winter, or remaining outside and being difficult to protect, induces potential premature wear.

There is therefore a need for improvement over the filtering systems and other sub-systems of swimming pools.

SUMMARY

According to an aspect of the disclosure, there is provided a staircase for removable installation in a swimming pool, the staircase comprising: a plurality of steps;

- a plurality of risers, the risers extending between the steps, wherein the steps and the risers define together a hidden space therebehind;
- a connector for a filtering system, comprising:
  - at least one of a water inlet and a water return outlet, which is mounted to one of the risers and the steps, and
  - a tube connecting to at least one of the water inlet and the water return outlet to another component of the filtering system, wherein the tube extends in the hidden space.

According to an embodiment, the staircase is removable from the swimming pool.

According to an embodiment, at least one of the steps comprises a wing portion for butting up against a receiving surface of the swimming pool.

According to an embodiment, the wing portion comprises a hole for mechanical fastening the staircase to the receiving surface of the swimming pool.

According to an embodiment, the wing portion comprises a recess with the hole located therein.

According to an embodiment, the staircase is less dense than water for floating when not mechanically fastened to the swimming pool.

According to an embodiment, said other component of the filtering system comprises a skimmer.

According to an embodiment, said other component of the filtering system comprises a water jet outlet.

According to an embodiment, one of the steps has a trapezoidal shape.

According to an embodiment, the trapezoidal step has a wide front and a narrow back, wherein at least one of the risers is a neighbor riser, and wherein the wide front is wider than each of the at least one neighbor riser.

According to another aspect of the disclosure, there is provided a pool comprising:

- a floor;
- two adjoining walls;
- a filtering system comprising a water inlet, a water return outlet, a filter, a pump, and tubing interconnected thereto; and
- a staircase comprising staircase steps and risers, defining a hidden space behind, the staircase adapted to adjoin the floor and the adjoining walls, the staircase being adapted for the inlet or the outlet to be mounted to one of the risers or the steps of the staircase, with the tube connected thereto extending in the hidden space.

According to an embodiment, the staircase is removable from the floor and the adjoining walls.

According to an embodiment, at least one of the steps comprises a wing portion for butting up against a receiving surface of the adjoining walls.

According to an embodiment, the wing portion of the staircase comprises a hole for mechanical fastening the staircase to the receiving surface.

According to an embodiment, the wing portion of the staircase comprises a recess with the hole located therein.

According to an embodiment, the receiving surface comprises a bolt extending therefrom for bolting the staircase thereto.

According to an embodiment, the staircase is less dense than water for floating when not mechanically fastened.

According to an embodiment, the filtering system further comprises at least one of: a skimmer and a water jet outlet.

According to an embodiment, the receiving surface is made of an embedded wall step, wherein a first one of the staircase steps has a wide front and a narrow back, wherein at least one of the risers is a neighbor riser neighboring the first staircase step, and wherein the wide front is wider than all of the at least one neighbor riser.

According to an embodiment, the first staircase step has a pair of wings for laying on the wall step.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
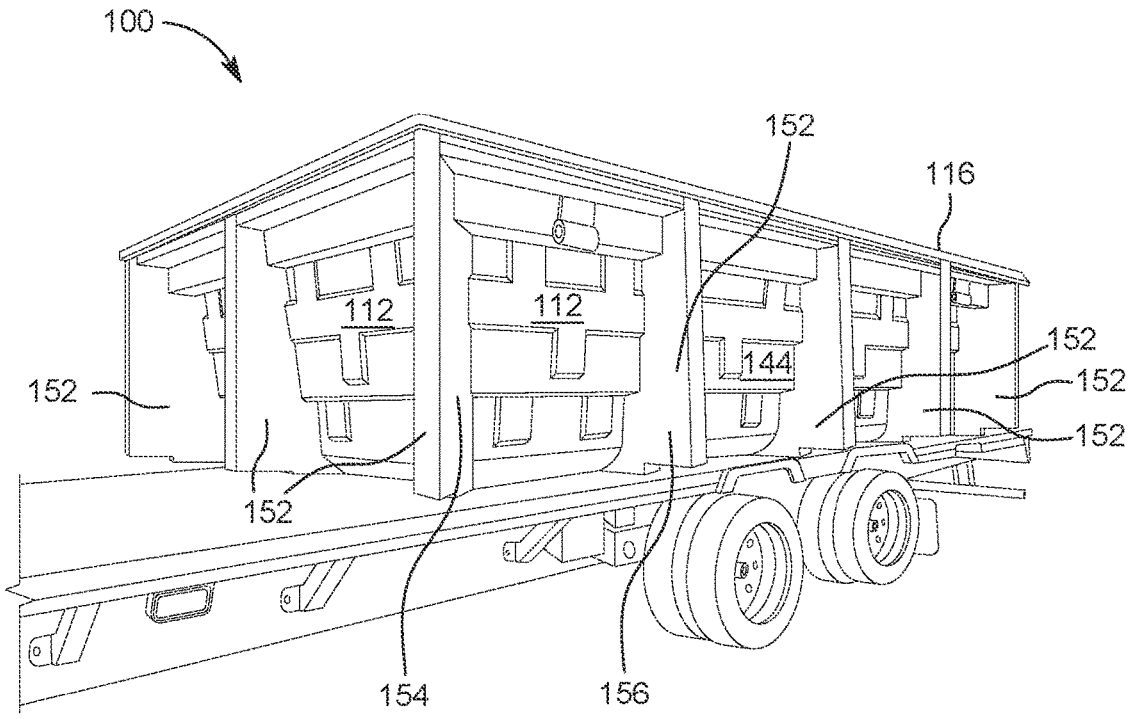
FIG. 1 is a first perspective view of a pool adapted to be installed therein a pool staircase with enclosed filtering components in accordance with an embodiment.
Figure 2:
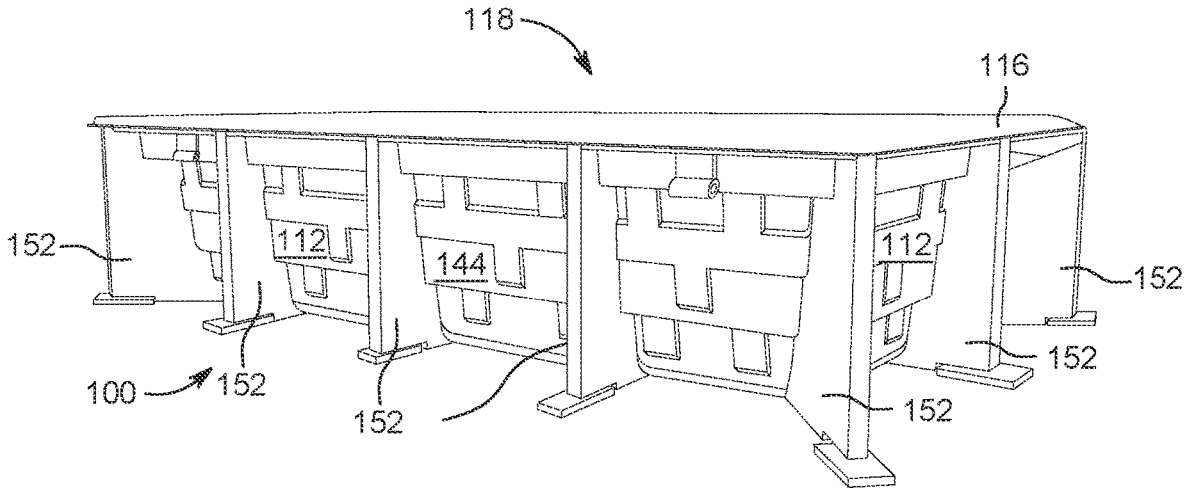
FIG. 2 is a second perspective view of the pool of FIG. 1 installed on concrete blocks.
Figure 3:
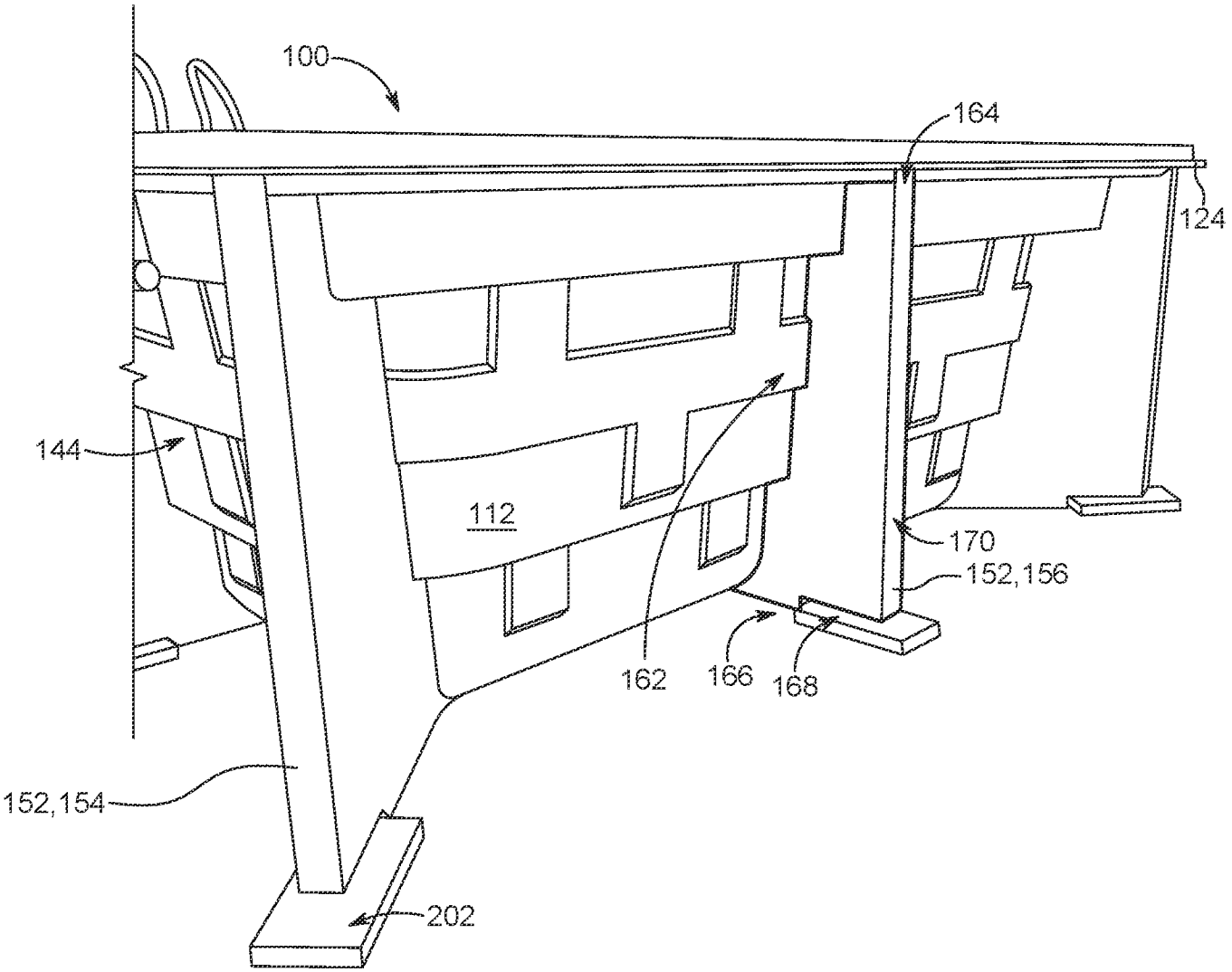
FIG. 3 is a side view of the exterior face of a wall of the pool of FIG. 1.
Figure 4:
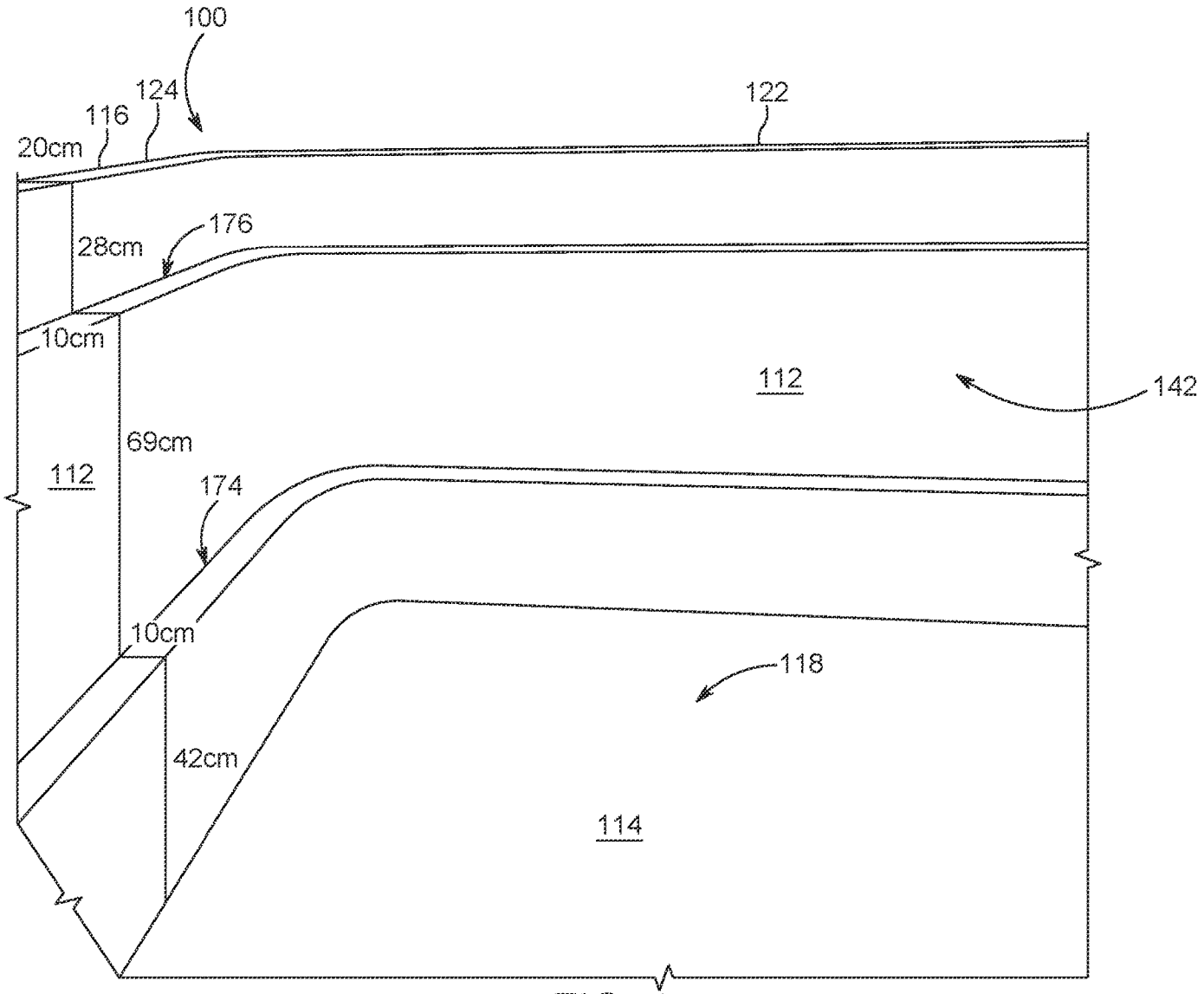
FIG. 4 is a side view of an interior face of a wall of the pool of FIG. 1.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of a swimming pool.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be noted that throughout the appended drawings, like features are identified by like reference numerals.

Referring now to the drawings provided through FIGS. 1 to 5, an above-ground swimming pool, or referred to more simply a pool 100 made of fiberglass (given as a non-limitative example) has a non-circular shape, preferably a rectangular shape.

The pool 100 in its exemplary rectangular shape comprises four walls 112 and a floor 114 forming together the reservoir 118 (applicable to any pool shape) designed to hold and retain a volume of water in the pool 100. The walls 112 and the floor 114 are preferably made of the same material, that is preferably fiberglass, and are manufactured as a single piece continuous structure featuring no connection, but rather modifications in orientation as the floor 114 raises at its periphery to form the four walls 112. The same applies to the junction of the walls 112 changing direction at their edges to form the adjoining wall 112.

The pool 100 further comprises a ledge 116 with the walls extending outwardly at their top edge to form the ledge 116.

Thereby, the walls 112, the floor 114 and the ledge 116 define an interior face 142, normally processed such as defining a smooth surface, and an exterior side surface 144, expected to be hidden once the pool 100 is installed.

The pool 100 has a water-holding periphery 122 defined by the maximum water-holding limit of the interior face 142, and a ledge periphery 124 defined by the external limit of the ledge 116 beyond the water-holding periphery 122.

The exterior side surface 144 normally extends below the ledge 116 and not beyond the ledge periphery 124, that is inwards or equal to the outer limit of the ledge 116 at that position, allowing to have the exterior side surface 144 hidden and the hiding material potentially extending about the ledge 116.

The exterior side surface 144 features a series of fins 152 scattered around the pool 100. The fins 152 are typically scattered around the pool 100 with one corner fin 154 located at each corner and extending at about e.g., 45 degrees from the joining walls 112 (when the joining walls have 90 degrees in-between), and zero, one or more intermediary fins 156 extending outwardly adjoined to the e.g., straight section of each of the walls 112. Typically, the number of one or more intermediary fins 156 is determined based on needs, particularly based on the length of the straight section of each wall.

The fins 152 typically comprises a junction edge 162 adjoining the walls 112, a first top edge 164 adjoining the ledge 116, an inner bottom edge 166, an outer bottom edge 168 and an outer edge 170. The junction edge 162 is designed to participate with the wall 112 to resist to outward pressure exerted by the water over the walls 112. The first top edge 164 is designed to provide support for the ledge 116. The inner bottom edge 166 is designed to abut against the ground. The outer bottom edge 168 is designed to be laid over a structural surface, e.g., concrete blocks 202, for leveled installation of the pool 100 and necessary stability. The outer edge 170 provides a surface, preferably a regular surface when considering the combination of find 152 against which may be installed a hiding wall for hiding the exterior side surface 144 of the pool 100 once installed.

According to an embodiment, the walls 112 of the pool 100 feature a plurality of sections of downwardly decreasing width, taking the shape of a stairs-like surface. According to an exemplary embodiment, the walls 112 extend about vertically from their junction to the floor 114 to a first step 174 over a first height, e.g., 42 cm, about horizontally over a first length, e.g., 10 cm, about vertically over a second height to a second step 176, e.g., 69 cm, about horizontally over a second length, e.g., 10 cm, and about vertically over a third height, e.g., 28 cm. The ledge 116 extends beyond its junction to the wall 112 over a fourth distance of e.g., 20 cm.

The interior face 142 is designed to provide an edge-free surface other than the stairs-like shape discussed before. Step edges and junctions are rounded to provide no undesired shape.

Figure 5:
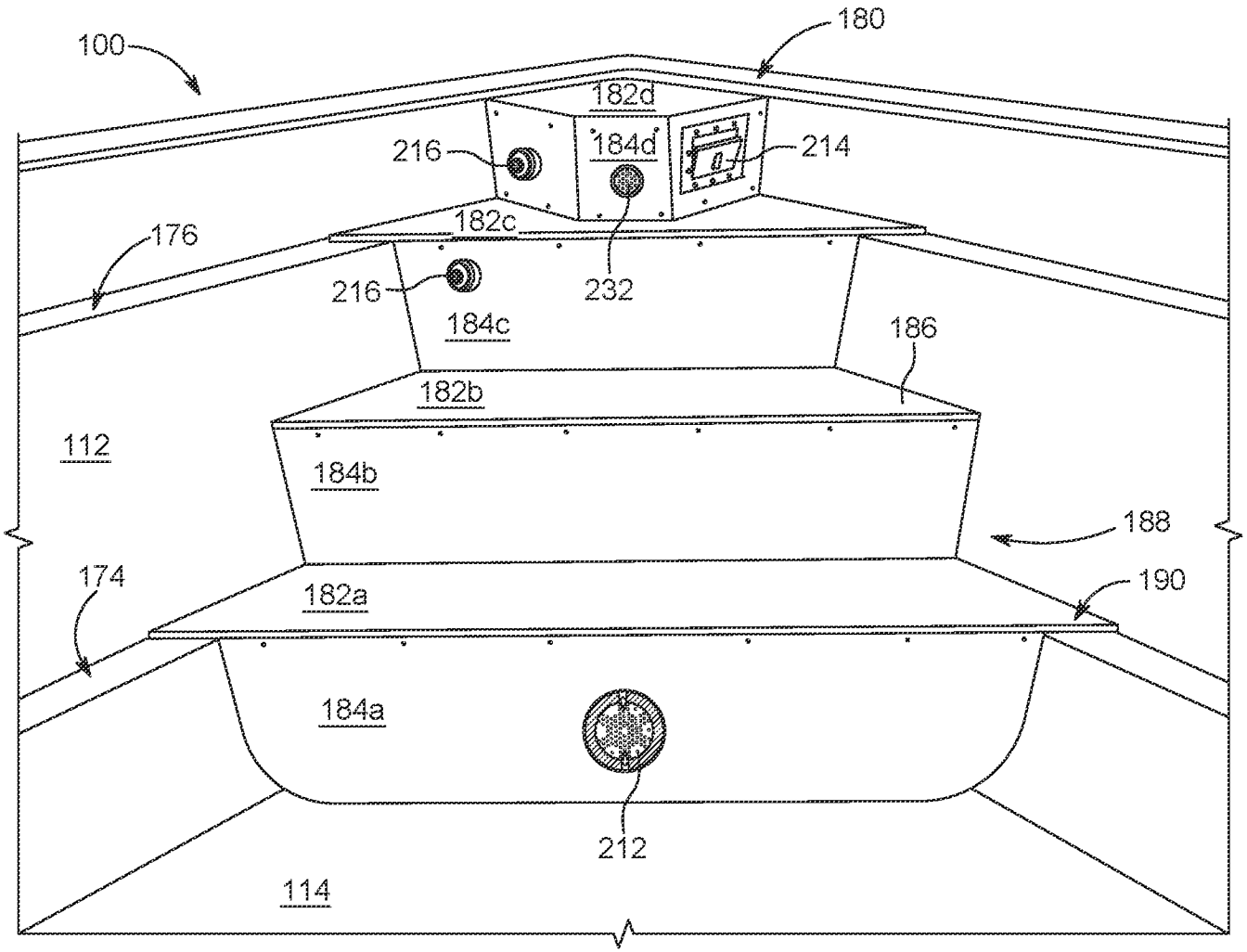
FIG. 5 is a side view of the interior face of a portion of the swilling pool of FIG. 1 with a staircase installed therein in accordance with an embodiment.

Referring particularly to FIG. 5, the pool 100 is adapted to receiving a separate and distinct staircase 180, not integral with the pool 100 described above and removable or detachable therefrom. The staircase 180 comprises a number of horizontally extending steps 182, e.g., trapezoidal steps, and a number of risers 184, e.g., rectangular risers, extending between the steps 182 and joining the steps 182. The outer surface of steps 182 and the risers 184 which when installed are oriented toward the inner volume of the pool 100 define together the exterior face 186 of the staircase 180, thereby defining (hiding) a hidden space 188 having a hidden volume under the staircase 180 and which is located between the floor 114, walls 112, and the exterior face 186.

According to one embodiment, the staircase 180 comprises wings 190 designed to be laid over the steps 174, 176 of the walls 112 in a corresponding or matching fashion with the steps 174, 176, thereby having the staircase 180 laid down over the multiple about horizontal surfaces and about vertical surfaces, preventing the staircase 180 to tip back when someone steps on a step 182 of the staircase 180. The removable staircase 180 can therefore be laid down onto the side or corner portion of the pool 100 and match the corresponding geometrical features for a complementary installation thereon. The removable staircase 180 can be installed and eventually removed, altogether with filtering equipment to be installed in a hidden space underneath, as described in greater detail further below, thereby providing suitable and easy removability of fragile components of the swimming pool during the winter season.

According to an embodiment, the staircase 180 comprises a plurality of inlets and outlets (more detail below) for water flow, the inlets and outlets providing fluid communication between the main volume of the pool 100 and the hidden volume under the removable staircase 180. The inlets comprise a drain 212 located in the lower riser 184. The drain 212 is designed for low-level water and material therein to enter the filtering system 210. The inlets further comprise a skimmer mouth 214 for water close to the surface to enter the filtering system. The outlets comprise one or more, e.g., two, return outlets 216 designed to reject the filtered water back in the reservoir, with the direction of the jets being customable, e.g., directable about parallel to the wall 112 adjoined to the wall close to the skimmer mouth 214 of the skimmer 218.

Figure 6:
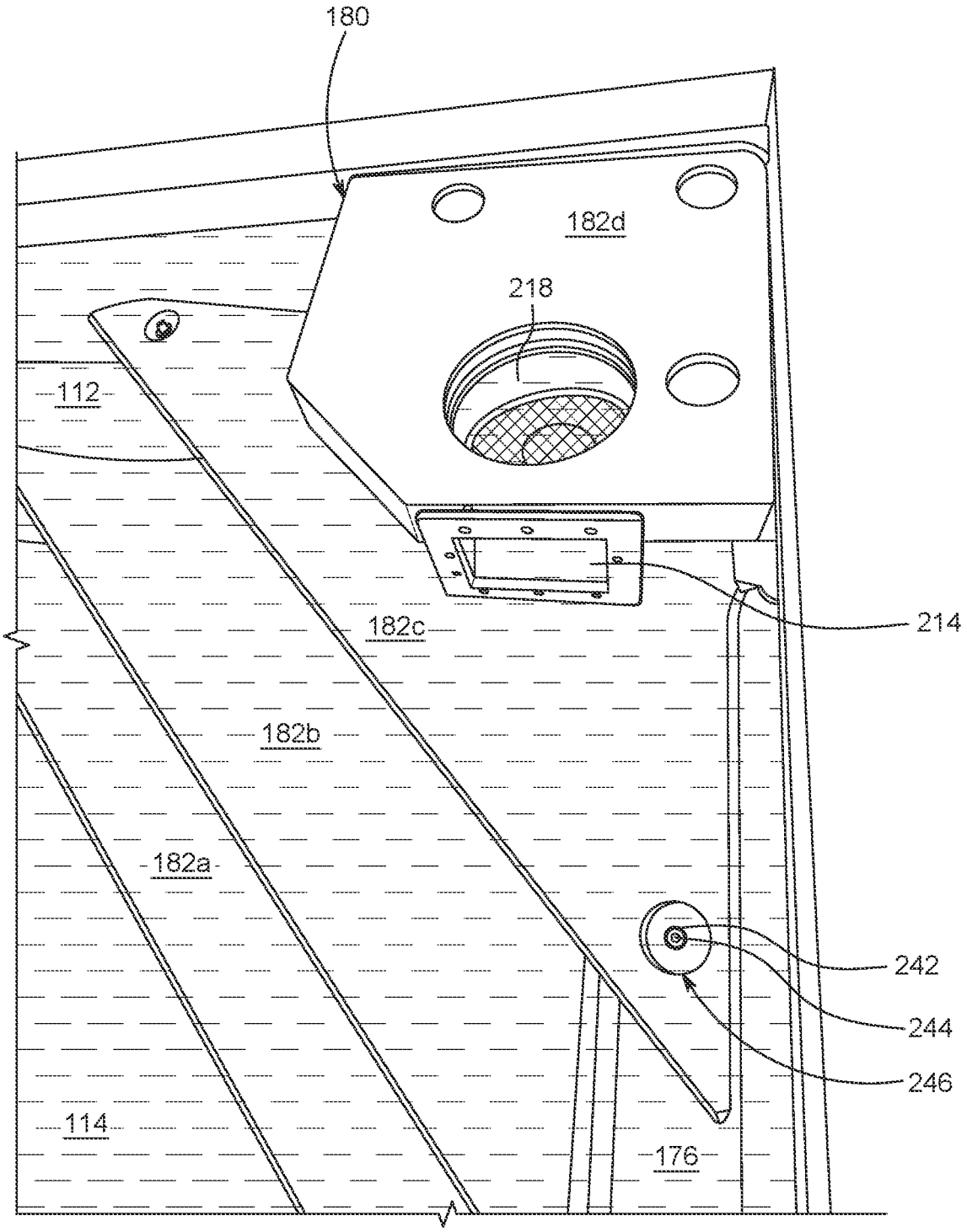
FIG. 6 is a perspective view of the interior face of a portion of the swimming pool with a staircase installed therein and mechanically fastened thereto in accordance with an embodiment.

Referring to FIG. 6, there is depicted an oblique elevation perspective view of the interior face of a portion of the swimming pool 100 with a staircase 180 installed therein and mechanically fastened thereto. The staircase 180 is removably secured or fastened to the pool using nuts 242 mountable to bolts 244 mounted to the pool 100 permanently or removably.

According to an embodiment of the disclosure, the bolts 244 extend upward from the top pool step 176, extending through a hole in the wing 190 of the top staircase step 182. Such mechanical fastening allows the staircase 180 to be stably installed therein while being both lightweight and free of the necessity to attach weights to it when mounting the staircase 180 to the pool 100.

According to a preferred embodiment, the wing 190 features a recess 246 with the hole located in the recess 246, whereby the nut 242 may be mounted to the bolt 244 without exceeding the surface of the wing 190. According to an embodiment (not depicted), a removable cap may be installed to cap the recess 246 over the nut for security and esthetic reasons.

Figure 7:
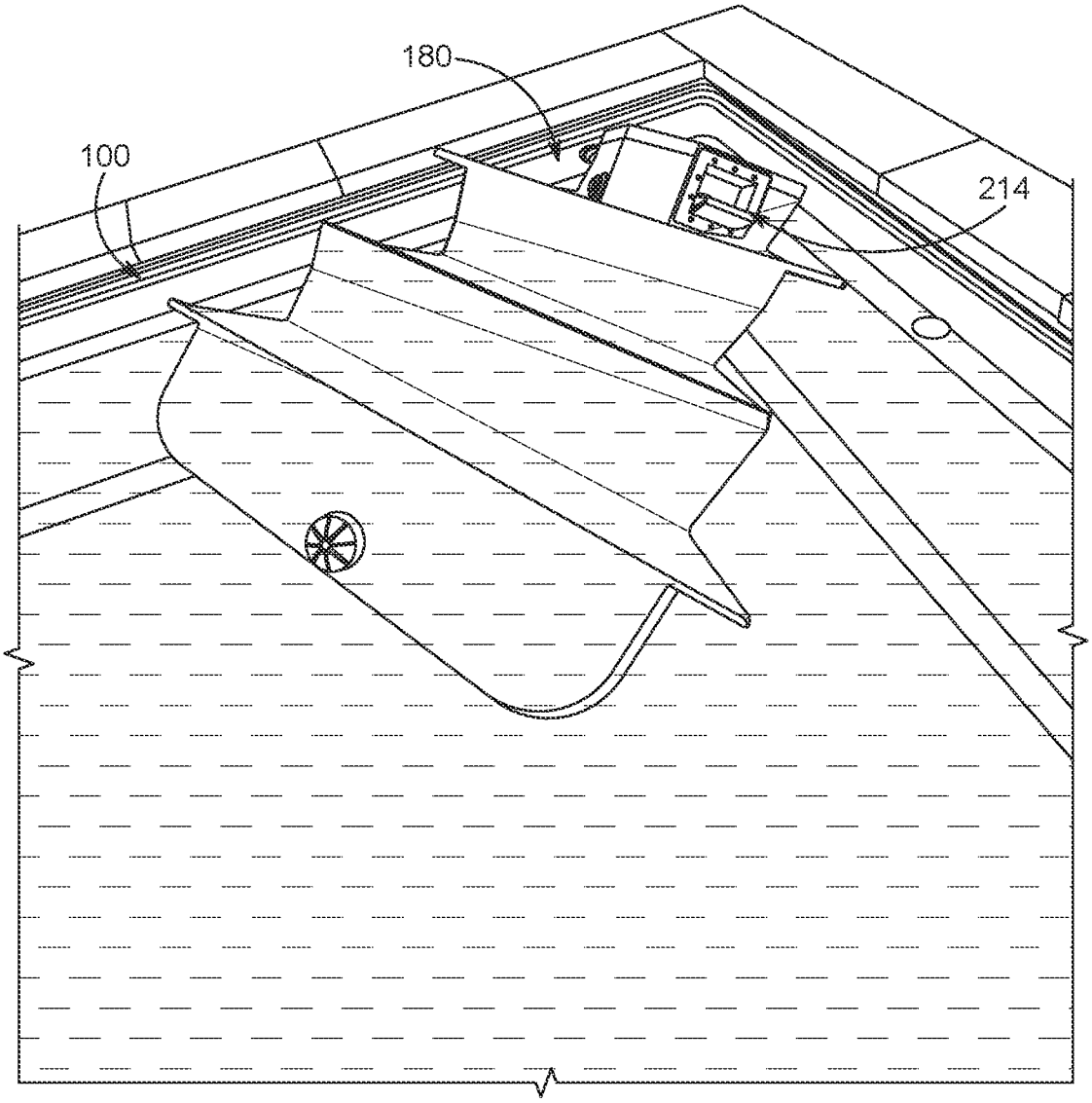
FIG. 7 is a perspective view of the interior face of a portion of the swimming pool with a staircase installed therein that is not mechanically fastened thereto in accordance with an embodiment.

Referring to FIG. 7, it depicts an elevation perspective view of the interior face of a portion of the swimming pool 100 with a staircase 180 installed therein when not mechanically fastened thereto (e.g., unbolted), showing that since the staircase 180 is lightweight (less dense than water), it floats, easing the process of removing the staircase 180 from the pool 100 when winter comes.

Figure 8:
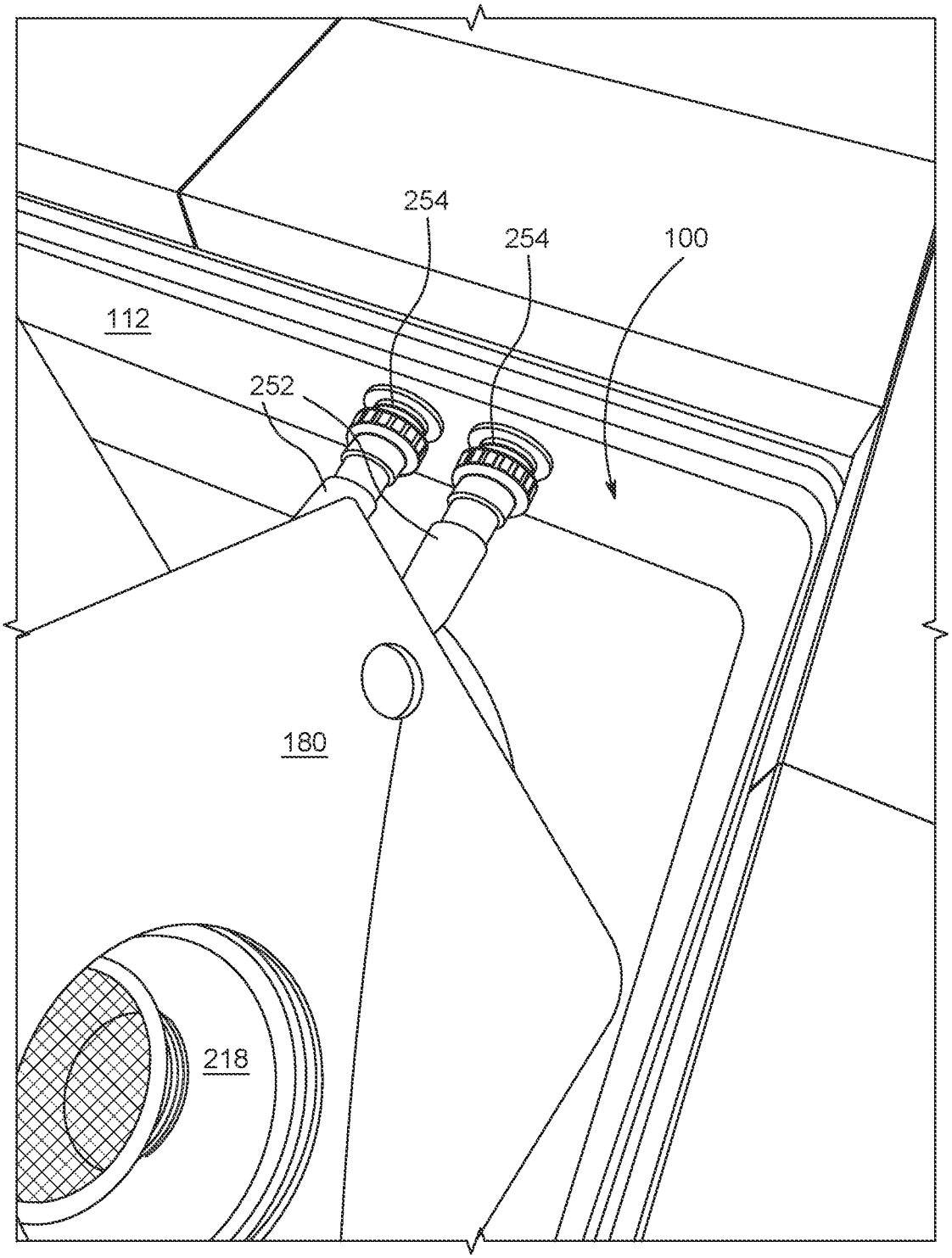
FIG. 8 is a perspective view of an area close to the top of the staircase when the staircase is not mechanically fastened to the pool in accordance with an embodiment.
Figure 9:
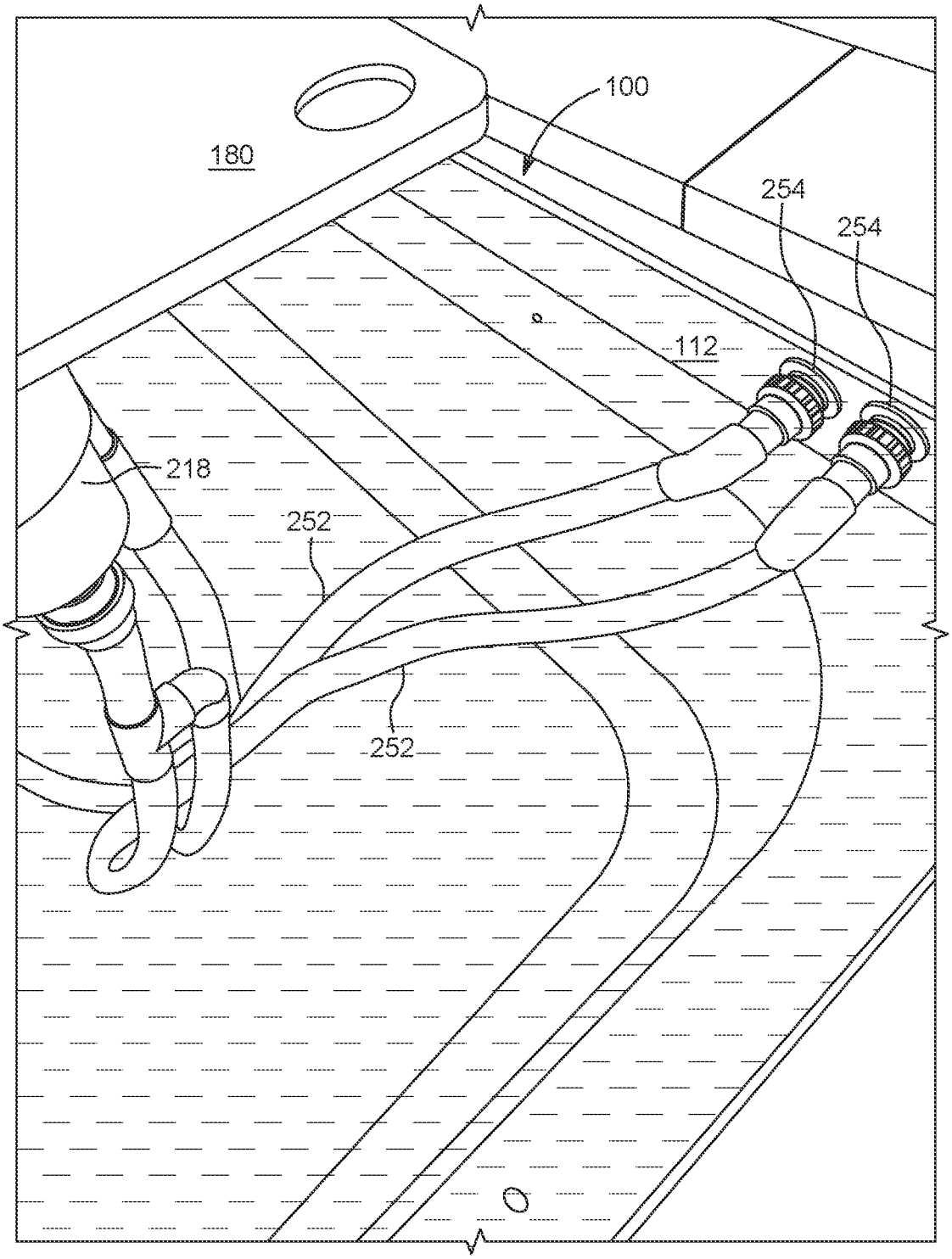
FIG. 9 is a perspective view of an area of the swimming pool where the top of the staircase is to be mounted to the pool in accordance with an embodiment.
Figure 10:
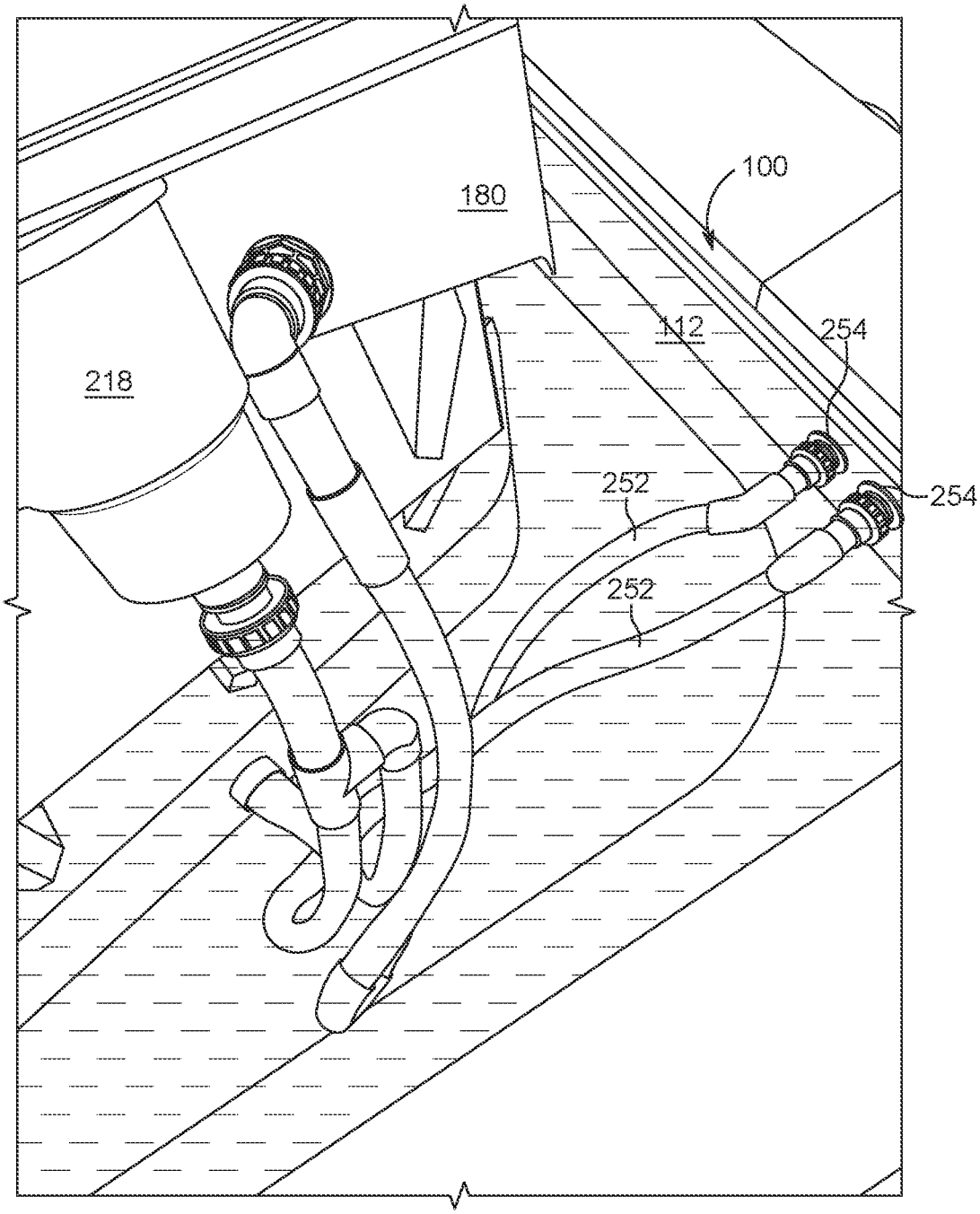
FIG. 10 is a perspective view showing a portion of the pool, a portion of the back of the staircase with accessories mounted thereto and tubing connecting the staircase to the wall of the swimming pool in accordance with an embodiment.

Referring to FIGS. 8 to 10, it depicts an elevation view of an area close to the top of the staircase 180 when the staircase 180 is not mechanically fastened to the pool 100. It shows that when the staircase 180 is floating, the top of the staircase can be moved away from the side of the pool 100, thereby providing access to the immersed tubing 252 normally extending thereunder.

It is worth noting that to ease the removal and the installation of the immersed tubing 252 and the staircase 180, connectors 254 are permanently mounted to the wall 112 of the pool 100, preferably above the normal water surface.

It is further worth noting that the volume hidden behind the staircase 180 allows to have immersed tubing 252 of sufficient length allowing to easily access the connections to the accessories under the staircase 180 and the connections to the connectors 254 mounted wall 112 without enough clearance.

Figure 11:
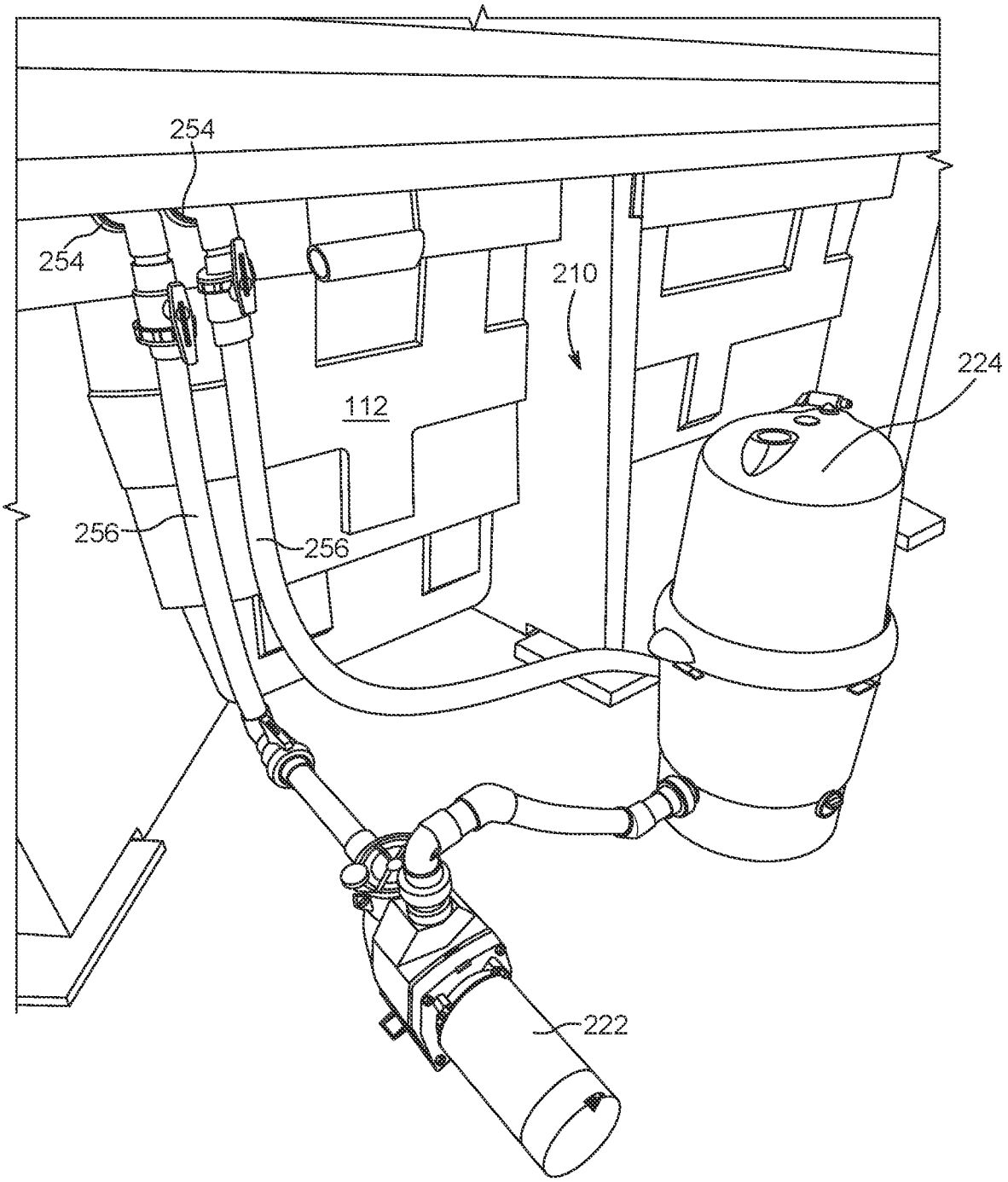
FIG. 11 is a side view of an area of the exterior of the swimming pool with accessories of the filtration system connected thereto in accordance with an embodiment.

Referring to FIG. 11, it depicts a side view of an area of the exterior of the swimming pool with accessories of the filtering system 210 connected thereto. It depicts a pump 222 a filter 224, and the tubing 256 connecting them to the pool 100 through the connectors 254 mounted to the wall 112 of the pool 100 and which connect to and fluidly communicate with the hidden space 188.

It is to be noted that these are exemplary components of a filtering system 210. Other filtering systems may comprise heaters and other accessories not depicted therethrough without departing from the scope of the present description.

Figure 12:
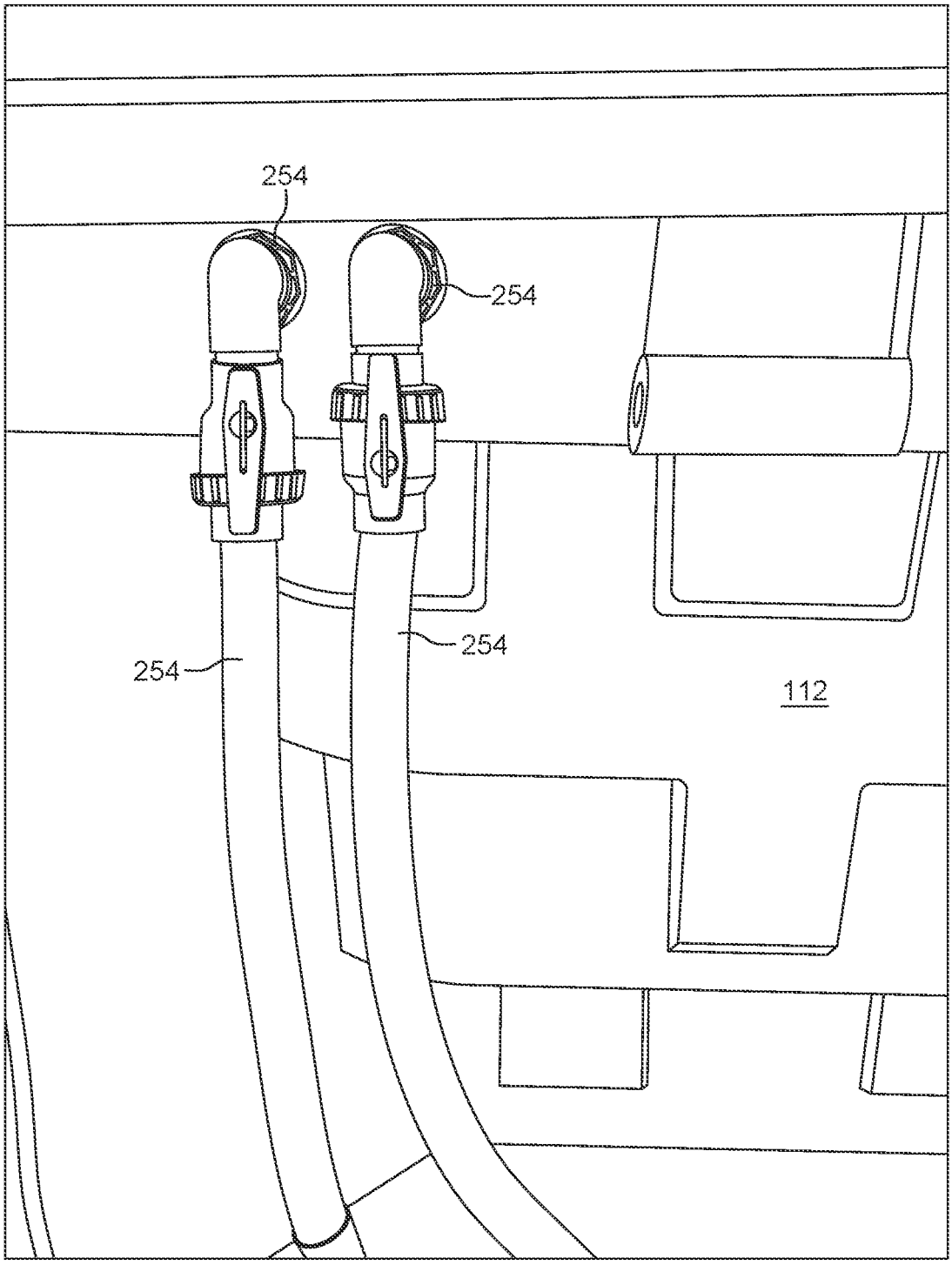
FIG. 12 is a close-up view of an area of the exterior of the swimming pool showing the connections between the swimming pool and tubing connected thereto in accordance with an embodiment.

Referring to FIG. 12, it depicts a close-up view of an area of the exterior of the swimming pool 100 showing from the exterior side the connectors 254 mounted to the wall 112 and the tubing 256 connected thereto.

According to an embodiment, the staircase 180 is modular, with some components, e.g., the top step 182, being dismountable from the remaining parts of the staircase 180 to provide access to components of the filtering system 210 without unfastening the whole staircase 180.

According to an embodiment, the staircase 180 comprises a light port 232, shown in FIG. 5, providing ambiance lighting.

According to an embodiment, the staircase 180 extends beyond the height of the ledge 116. The extended staircase 180 features a set of back and/or side risers with at least one of the latter providing passage for tubes, electrical cables, or other components of the filtering system and/or the lighting system to pass therethrough. Accordingly, at least part of the filtering system, e.g., the pump 222, may be located in the hidden space 188 while another part of the filtering system, e.g., the filter 224, or the contrary, may be located outside the pool 100.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A staircase and at least part of a filtration system for removable installation in a swimming pool, the staircase comprising:

a plurality of steps;

a plurality of risers, the risers extending between the steps, wherein the steps and the risers define together a hidden space therebehind;

a connector for a filtering system, comprising:

at least one of a water inlet and a water return outlet, which is mounted to one of the risers and the steps, and a tube connecting to at least one of the water inlet and the water return outlet to another component of the filtering system, wherein the tube extends in the hidden space, wherein the staircase is removable from a floor and adjoining walls of the swimming pool, wherein at least one of the steps comprises a wing portion for butting up against a receiving surface of the adjoining walls, and wherein the receiving surface is made of an embedded wall step, wherein a first one of the staircase steps has a wide front and a narrow back, wherein at least one of the risers is a neighbor riser neighboring the first staircase step, and wherein the wide front is wider than all of the at least one neighbor riser.

2. The staircase and the at least part of a filtration system of claim 1, wherein said other component of the filtering system comprises a skimmer.

3. The staircase and the at least part of a filtration system of claim 1, wherein said other component of the filtering system comprises a water jet outlet.

4. The staircase and the at least part of a filtration system of claim 1, wherein one of the steps has a trapezoidal shape.

5. The staircase and the at least part of a filtration system of claim 1, wherein the staircase is removable from the swimming pool.

6. The staircase and the at least part of a filtration system of claim 5, wherein the staircase is less dense than water for floating when not mechanically fastened to the swimming pool.

7. The staircase and the at least part of a filtration system of claim 1, wherein the wing portion comprises a hole for mechanical fastening the staircase to the receiving surface of the swimming pool.

8. The staircase of and the at least part of a filtration system claim 7, wherein the wing portion comprises a recess with the hole located therein.

9. A pool comprising:

a floor;

two adjoining walls;

a filtering system comprising a water inlet, a water return outlet, a filter, a pump, and tubing interconnected thereto; and a staircase comprising staircase steps and risers, defining a hidden space behind, the staircase adapted to adjoin the floor and the adjoining walls, the staircase being adapted for the inlet or the outlet to be mounted to one of the risers or the steps of the staircase, with the tube connected thereto extending in the hidden space, wherein the staircase is removable from the floor and the adjoining walls, wherein at least one of the steps comprises a wing portion for putting up against a receiving surface of the adjoining walls, and wherein the receiving surface is made of an embedded wall wherein a first one of the staircase steps has a wide front and a narrow back, wherein at least one of the risers is a neighbor riser neighboring the first staircase step, and wherein the wide front is wider than all of the at least one neighbor riser.

10. The pool of claim 9, wherein the first staircase step has a pair of wings for laying on the wall step.

11. The pool of claim 9, wherein the wing portion of the staircase comprises a hole for mechanical fastening the staircase to the receiving surface.

12. The pool of claim 11, wherein the wing portion of the staircase comprises a recess with the hole located therein.

13. The pool of claim 12, wherein the receiving surface comprises a bolt extending therefrom for bolting the staircase thereto.

14. The pool of claim 13, wherein the staircase is less dense than water for floating when not mechanically fastened.

15. The pool of claim 14, wherein the filtering system further comprises at least one of: a skimmer and a water jet outlet.

* * * * *